US005102138A

United States Patent [19]

Johnson

[11] Patent Number: 5,102,138

[45] Date of Patent: Apr. 7, 1992

[54] PORTABLE GAMING DEVICES

[76] Inventor: Robert J. Johnson, 1707 N. Harrison, Fort Wayne, Ind. 46808

[21] Appl. No.: 702,394

[22] Filed: May 20, 1991

[51] Int. Cl.[5] ..... A63F 5/04

[52] U.S. Cl. ..... 273/144 B; 273/DIG. 25; 273/142 E

[58] Field of Search ..... 273/144 B, 144 R, 142 E, 273/142 F, 142 G, 142 D, DIG. 25

[56] References Cited

U.S. PATENT DOCUMENTS

| | | | |
|---|---|---|---|
| 2,103,151 | 12/1937 | Dietrich | 273/144 B |
| 2,164,682 | 7/1939 | Keith | 273/144 B |
| 3,014,724 | 12/1961 | Cryder et al. | 273/DIG. 25 |
| 3,980,306 | 9/1976 | Tollefson | 273/DIG. 25 |
| 4,243,223 | 1/1981 | Ver Hoef et al. | 273/DIG/ 25 |

FOREIGN PATENT DOCUMENTS

| | | | |
|---|---|---|---|
| 3717593 | 12/1988 | Fed. Rep. of Germany | 273/144 B |
| 855428 | 11/1960 | United Kingdom | 273/144 B |

*Primary Examiner*—Benjamin Layno
*Attorney, Agent, or Firm*—Thomas J. Dodd

[57] ABSTRACT

A portable gaming device which is adaptable to simulate the action of several popular casino games. The device includes a spinning wheel rotatably mounted to a support. The spinning wheel defines an interior chamber which houses a plurality of game pieces. As the wheel is rotated, the game pieces are mixed until the wheel is stopped, whereupon one or more game pieces are displayed in a window to determine the result.

3 Claims, 3 Drawing Sheets

PORTABLE GAMING DEVICES

SUMMARY OF THE INVENTION

This invention relates to gaming devices and has special application to portable gaming devices which simulate the action of the game.

Casino and lottery games have always been popular. Such games include bingo, lotto, keno, poker, craps and roulette, to name just a few. The portable gaming device of this invention simulates the action of the above games and can be used in the home, during travel, or at other times when an individual is not actually in a gaming hall.

The device includes a spinning wheel which is rotatably mounted to a support. The wheel, which is substantially opaque, houses a plurality of gaming pieces which are mixed during rotation of the wheel. When the wheel stops, the appropriate number of gaming pieces are displayed through a translucent part of the wheel to determine the result as in the real game. The support and wheel may take on various shapes depending on the type of game being simulated and the place and means of its intended use.

Accordingly, it is an object of this invention to provide for a portable gaming device which simulates the action of an actual casino game.

Another object is to provide for a gaming device which can be adapted to simulate a number of different games.

Another object is to provide for a gaming device which is reliable and which is economical.

Other objects will become apparent upon a reading of the following description.

DESCRIPTION OF THE PREFERRED EMBODIMENTS

Figure 1:
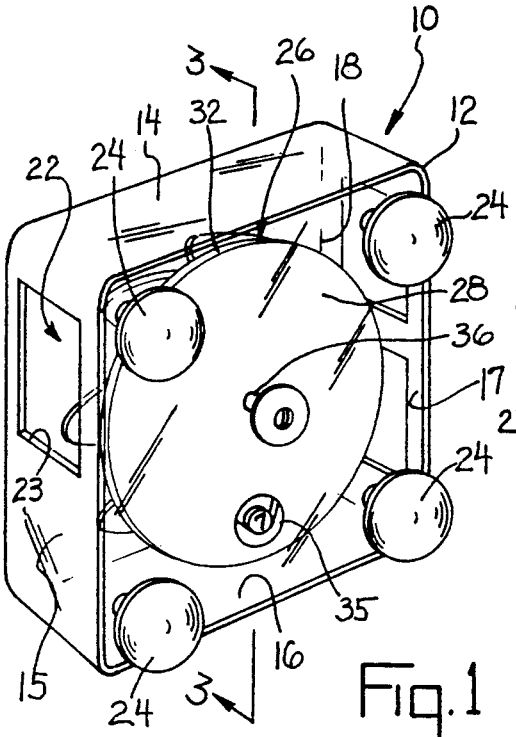
FIG. 1 is a front perspective view of a first embodiment of the gaming device of this invention.
Figure 2:
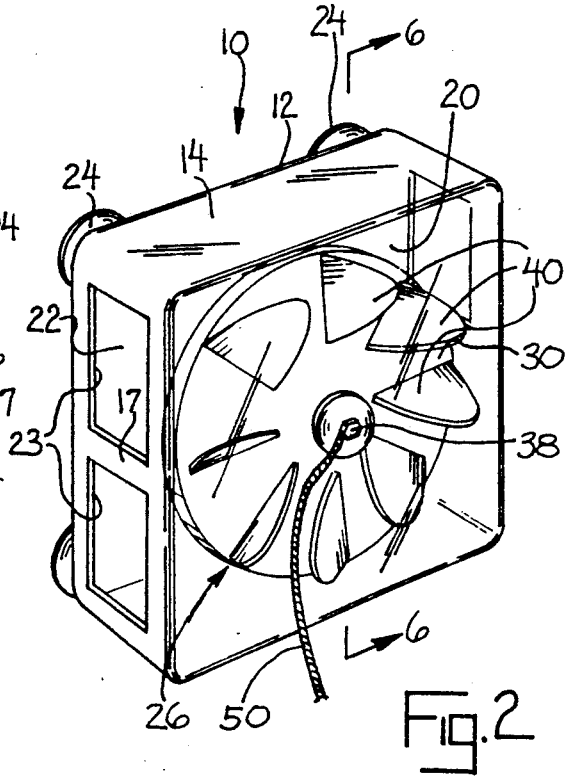
FIG. 2 is a rear perspective view of the device of FIG. 1.
Figure 3:
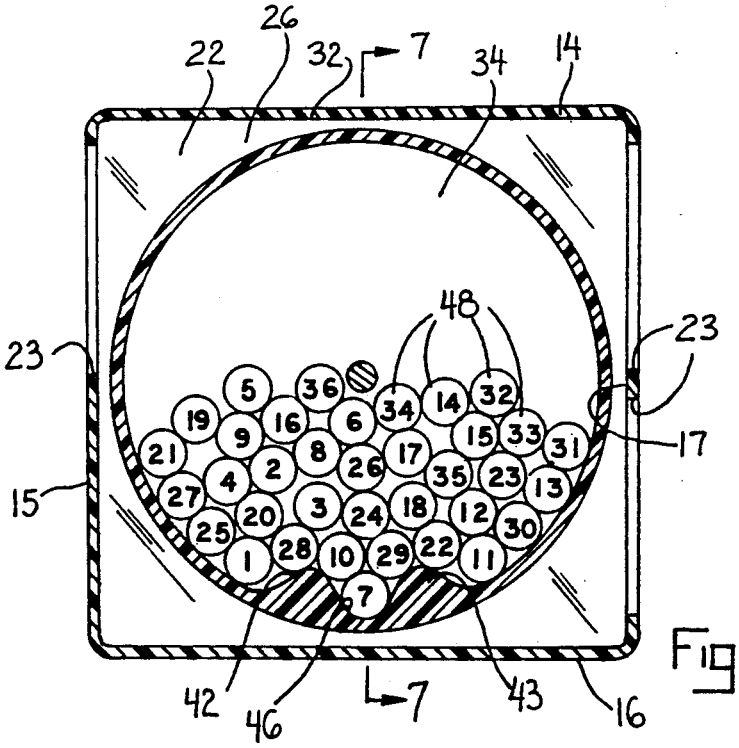
FIG. 3 is a cross-sectional view taken along line 3—3 of FIG. 1.

The preferred embodiments herein described are not intended to be exhaustive or to limit the invention to the precise forms disclosed. They are chosen and described to explain the principles of the invention and their application and practical use to enable others skilled in the art to follow their teachings.

FIGS. 1-3 and 5 depict a first embodiment of a gaming device 10 constructed according to the principles of this invention. Device 10 as shown is adapted to simulate the action of a casino roulette wheel, but could be adapted to simulate any number of other games.

Device 10 includes a transparent housing 12 which is defined by side walls 14, 15, 16, 17 and end walls 18, 20 to define an inner chamber 22. Suction cups 24 are fastened to end wall 18 and allow housing 12 to be mounted to a surface such as a car window or the like (not shown). Housing 12 has one or a plurality of holes 23 (three shown) to allow air flow communication between the outside and inner chamber 22.

Figure 6:
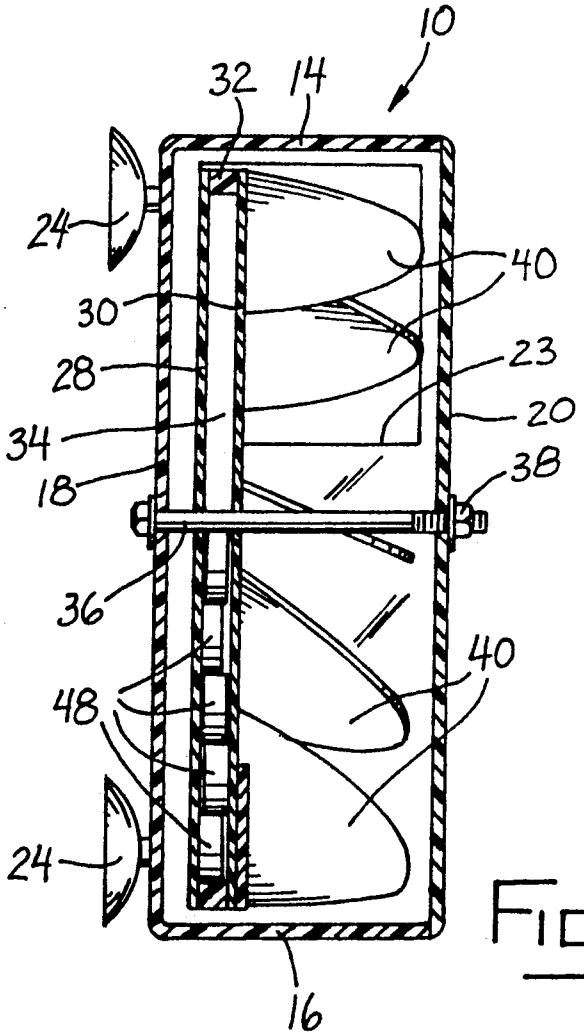
FIG. 6 is a cross-sectional view taken along line 6—6 of FIG. 2.

Spinner 26 is rotatably connected to housing end walls 18, 20 as shown in FIG. 6. Spinner 26 is preferably round in shape and includes front wall 28 rear wall 30 and continuous peripheral end wall 32 to define a hollow chamber 34. Bolt 36 extends through housing end wall 18, spinner walls 28, 30 and housing end wall 20. Nut 38 secures the bolt 36 to the housing 12 as shown. Bushings or similar components (not shown) may also be used in the attachment of spinner 26. A plurality of arcuate vanes 40 project from and are attached to spinner wall 28. Spinner 26 is substantially opaque.

Spinner 26 includes raised integral projections 42, 43 within chamber 34. Projections 42, 43 define a recess 46 which is located adjacent a transparent window portion 35 of spinner front wall 30. A plurality of substantially round game pieces 48 are housed in chamber 34 as shown. In this embodiment, device 10 is adapted to simulate the action of a spin on a roulette wheel, hence the presence of thirty-six game pieces 48 numbered consecutively and the construction of recess 46 and window 35 to display a single winning number. Other games can be simulated by altering the recess 46 and window 35 to display as many numbers as required and the construction of game pieces 48 altered to correspond to the probabilities corresponding to the game being simulated. For instance if a person wanted to simulate the action of horse race betting, the display would be altered to display three numbers (for win, place and show) and the number of game pieces 48 would be reduced. If one wished to simulate a poker game, fifty-two game pieces 48 denoting a deck of cards could be used and the display configured to expose from five to seven cards as desired.

Device 10 is adapted for operational use as follows. Device 10 is preferably affixed to the outside of a vehicle window (not shown) by pressing suction cups 24 onto the glass. As the vehicle (not shown) travels, air passes through holes 23 in housing 12 and acts on vanes 40 to turn spinner 26 and mix game pieces 48. When the vehicle stops, spinner 26 ceases to rotate and the added weight of projections 42, 43 serves to align recess 46 at the bottom of the housing in alignment with window 35. All that is left is for the user to read the winning number and check the results of his (and perhaps other vehicle occupants) guess. Operated in this fashion, device 10 serves to simulate the action of roulette (or other games) for all participants in the vehicle. String 50 may be attached to bolt 36 to prevent device 10 from being lost if suction cups 24 disengage from the vehicle window (not shown).

Figure 5:
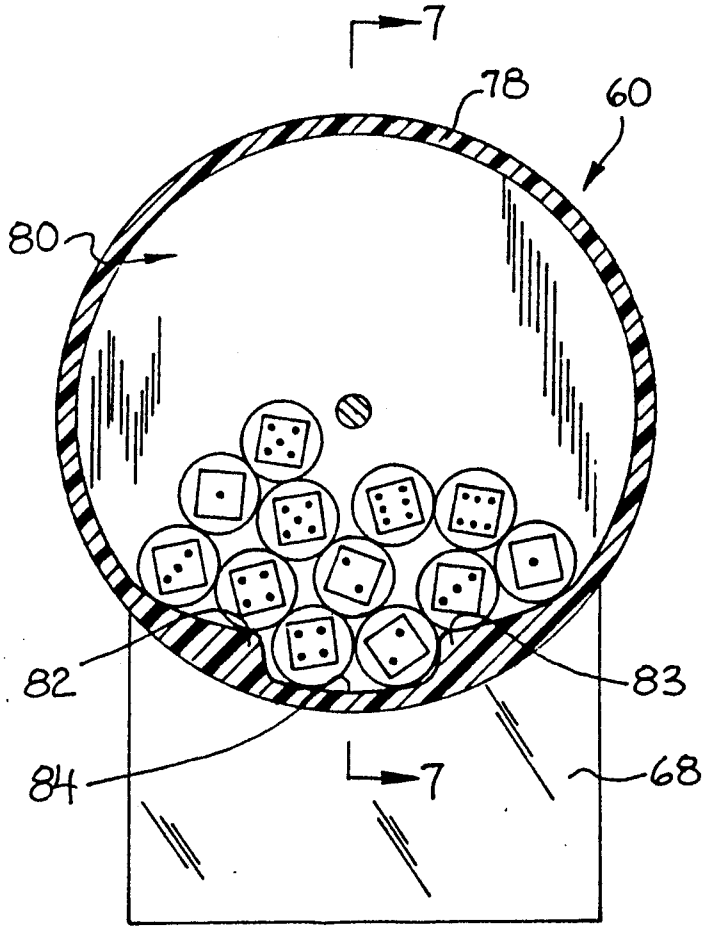
FIG. 5 is a cross-sectional view of the device taken along line 5—5 of FIG. 4.
Figure 4:
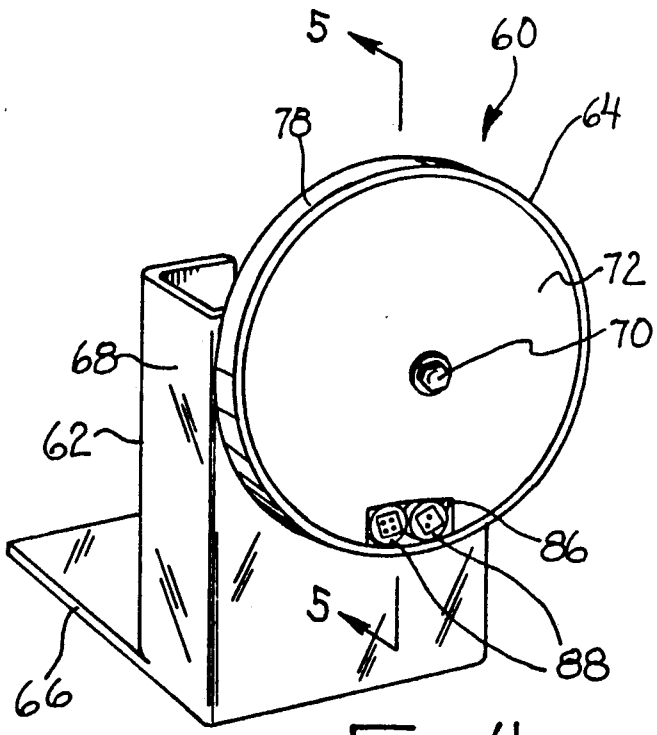
FIG. 4 is a perspective view of an alternate embodiment of the gaming device.
Figure 7:
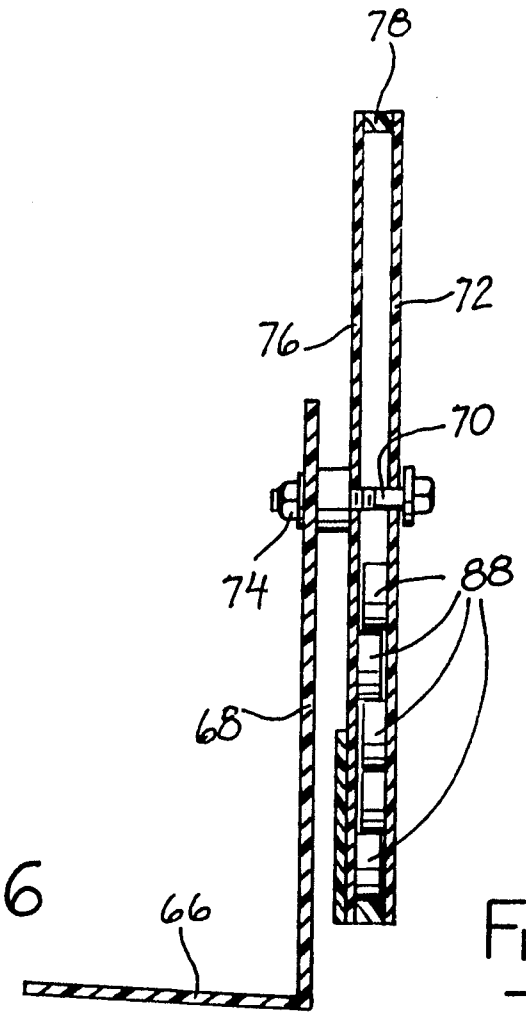
FIG. 7 is a cross-sectional view taken along line 7—7 of FIG. 5.

FIGS. 4, 5 and 7 illustrate a modified device 60 which includes support stand 62 and spinner 64. Stand 62 includes a base 66 and upright 68 with the spinner 64 rotatably connected to the upright.

Spinner 64 is constructed in a similar fashion to spinner 26 and is rotatably connected to upright 68 by bolt 70 and nut 74 as shown in FIG. 7. Spinner 64 includes front wall 72 and rear wall 76 which has a continuous peripheral flange 78 to define interior hollow chamber 80. Flange 78 has thickened inner portions 82, 83 to define recess 84. Spinner front wall 72 and rear wall 76 are substantially opaque with the front wall having a window portion 86 as shown to display the result. Game pieces 88 are housed in chamber 80.

In the embodiment shown, the game being simulated is craps (or other dice games which utilize the roll of two dice to determine a result). To operate device 60, a user simply spins spinner 64 about bolt 70 to mix game pieces 88. When the spinner momentum is spent, the result is displayed through window 86 as seen in FIG. 5. As with device 10, device 60 can be modified to simulate the action of numerous games as described above.

It is understood that the above description does not limit the invention to the given details, but may be modified within the scope of the following claims.

I claim:

1. A gaming device comprising a housing, a spinner rotatably connected to said housing, said spinner being substantially opaque and defining an inner chamber, a plurality of game pieces housed in said chamber, said spinner including a transparent section for displaying at least one of said game pieces when the spinner is stationary, said housing including fastener means for detachably connecting the housing to a support surface, holes defined in said housing to allow air to reach said spinner, said spinner including connected vane means for catching moving air to cause rotation of the spinner relative to the housing.

2. The gaming device of claim 1 wherein said spinner includes interior projections defining a recess for housing at least one of said game pieces, said recess positioned in line with said spinner transparent section to allow visual reading of said game piece.

3. The gaming device of claim 1 wherein said housing is a portable support stand for supporting said spinner above a table surface.

* * * * *

UNITED STATES PATENT AND TRADEMARK OFFICE

CERTIFICATE OF CORRECTION

PATENT NO. : 5,102,138

DATED : April 7, 1992

INVENTOR(S) : Robert U. Johnson

It is certified that error appears in the above-identified patent and that said Letters Patent is hereby corrected as shown below:

TITLE PAGE [76] Inventor: ROBERT J. JOHNSON ---- should be corrected to read [76] Inventor: ROBERT U. JOHNSON -------

Signed and Sealed this

Fifteenth Day of June, 1993

Attest:

Michael K. Kirk

MICHAEL K. KIRK

Attesting Officer

Acting Commissioner of Patents and Trademarks